US008177087B2

(12) United States Patent
Noble et al.

(10) Patent No.: US 8,177,087 B2
(45) Date of Patent: May 15, 2012

(54) CONCRETE WASHOUT BAG SYSTEM

(76) Inventors: Robert Noble, Bridgewater, NJ (US); John Calo, Bridgewater, NJ (US)

( * ) Notice: Subject to any disclaimer, the term of this patent is extended or adjusted under 35 U.S.C. 154(b) by 362 days.

(21) Appl. No.: 12/571,458

(22) Filed: Oct. 1, 2009

(65) Prior Publication Data

US 2010/0111449 A1 May 6, 2010

Related U.S. Application Data

(60) Provisional application No. 61/197,759, filed on Oct. 31, 2008.

(51) Int. Cl.
*B65D 25/16* (2006.01)
*B65D 30/16* (2006.01)
*B65D 33/02* (2006.01)

(52) U.S. Cl. ..... 220/9.4; 220/9.1; 220/666; 383/16; 383/22; 383/24; 383/76; 4/506; 4/585

(58) Field of Classification Search ..... 108/56.1, 108/56.3; 119/61.1; 134/104.2; 137/312–314; 138/120, 155; 184/106; 220/4.16, 4.26–4.29, 220/4.33, 7, 9.1–9.4, 23.2, 23.4, 23.8, 475, 220/480, 481, 571, 571.1, 573, 605, 628–630, 220/638, 646, 647, 666, 668, 677, 904, DIG. 25; 296/38; 383/9, 12, 15, 16, 22–24, 38, 39, 383/72, 76; 405/114, 116, 119–123; D25/60; 4/506, 585

See application file for complete search history.

(56) References Cited

U.S. PATENT DOCUMENTS

| | | | | | |
|---|---|---|---|---|---|
| 505,688 | A | * | 9/1893 | Wendell | 383/76 |
| 1,642,643 | A | * | 9/1927 | Carruth | 220/9.1 |
| 1,664,887 | A | * | 4/1928 | Kirkham et al. | 52/169.7 |
| 1,861,431 | A | * | 5/1932 | Crawford | 383/6 |
| 2,567,514 | A | * | 9/1951 | Hoffman | 4/587 |
| 2,638,951 | A | * | 5/1953 | Smith et al. | 220/666 |
| 2,749,956 | A | * | 6/1956 | Eldred | 220/9.3 |
| 3,026,539 | A | * | 3/1962 | Lewis | 4/587 |
| 3,660,853 | A | * | 5/1972 | Ducrocq et al. | 4/506 |
| 3,827,471 | A | * | 8/1974 | Gregory et al. | 222/181.3 |
| 3,961,655 | A | * | 6/1976 | Nattrass et al. | 383/24 |
| 4,020,922 | A | * | 5/1977 | Klasel | 184/1.5 |
| 4,139,037 | A | * | 2/1979 | McGuigan | 383/9 |
| 4,201,307 | A | * | 5/1980 | Malloy | 220/62 |
| 4,224,970 | A | * | 9/1980 | Williamson et al. | 383/17 |
| 4,307,764 | A | * | 12/1981 | Nattrass | 383/17 |
| 4,356,853 | A | * | 11/1982 | Sekiguchi | 383/24 |
| 4,356,933 | A | * | 11/1982 | Connolly | 220/9.4 |
| 4,479,243 | A | * | 10/1984 | Derby et al. | 383/24 |
| 4,524,457 | A | * | 6/1985 | Marino | 383/17 |
| 4,597,102 | A | * | 6/1986 | Nattrass | 383/105 |
| 4,642,934 | A | * | 2/1987 | Carlson et al. | 43/55 |
| 4,765,775 | A | * | 8/1988 | Kroger | 405/52 |
| 4,781,473 | A | * | 11/1988 | LaFleur | 383/16 |
| 4,890,343 | A | * | 1/1990 | Schlags | 4/585 |
| 4,953,987 | A | * | 9/1990 | Schnaars | 383/67 |

(Continued)

*Primary Examiner* — J. Gregory Pickett
*Assistant Examiner* — Ned A Walker
(74) *Attorney, Agent, or Firm* — Baker & Rannells, PA

(57) ABSTRACT

A concrete washout bag system is disclosed that is easy to transport and to assemble at a construction site and includes a frame and a foldable washout bag which is assembled onto the frame by means of unitarily formed sleeves, and is manufactured from a strong, water-proof material that allows it to be hoisted for carrying away heavy loads without tearing and includes a drawstring closure for retaining of washout materials during the hoisting, removal process.

8 Claims, 12 Drawing Sheets

U.S. PATENT DOCUMENTS 5,009,189 A * 4/1991 Neff ..... 119/200
5,083,327 A * 1/1992 Gillebaard ..... 4/506
5,090,588 A * 2/1992 Van Romer et al. ..... 220/573
5,107,857 A * 4/1992 Linnemann et al. ..... 5/604
D334,238 S * 3/1993 Spedini ..... D25/2
5,316,175 A * 5/1994 Van Romer ..... 220/573
5,375,275 A * 12/1994 Sanders ..... 4/599
5,470,177 A * 11/1995 Hughes ..... 405/115
5,492,158 A * 2/1996 Haag ..... 141/98
5,511,683 A * 4/1996 Dailey ..... 220/573
5,547,312 A * 8/1996 Schmitz, Jr. ..... 405/52
5,592,702 A * 1/1997 Gillebaard, Jr. ..... 4/506
5,607,237 A 3/1997 LaFleur
5,622,021 A * 4/1997 Bookout ..... 52/582.1
5,762,233 A * 6/1998 Van Romer ..... 220/573
5,816,743 A * 10/1998 Schmitz, Jr. ..... 405/53
5,924,461 A * 7/1999 Shaw et al. ..... 141/86
5,943,709 A * 8/1999 Chiu ..... 4/506
6,019,243 A * 2/2000 Marino ..... 220/573
6,079,934 A * 6/2000 Beale ..... 414/607
6,088,848 A * 7/2000 Waterlyn ..... 4/585
6,092,686 A * 7/2000 Shaw et al. ..... 220/573
6,108,829 A * 8/2000 Wadsworth ..... 4/541.1
6,142,727 A 11/2000 Beale
6,155,772 A * 12/2000 Beale ..... 414/607
6,230,451 B1 * 5/2001 Stoller ..... 52/169.1
6,276,829 B1 * 8/2001 Popp ..... 383/24
6,308,728 B1 * 10/2001 Frazier ..... 137/312
6,315,495 B1 * 11/2001 Starheim ..... 405/129.8
6,389,616 B1 * 5/2002 Mussa ..... 4/506
6,405,386 B1 * 6/2002 Chang ..... 4/506
6,477,721 B2 * 11/2002 Lee ..... 4/506
6,561,372 B1 * 5/2003 Connolly ..... 220/9.1
6,604,250 B1 * 8/2003 Lee ..... 4/506
6,643,858 B2 * 11/2003 Lee ..... 4/506
6,672,799 B2 * 1/2004 Earl ..... 405/111
6,695,534 B2 * 2/2004 Cain et al. ..... 405/52
6,739,753 B2 * 5/2004 Richardson et al. ..... 383/16
6,742,198 B2 * 6/2004 Lee ..... 4/506
6,880,720 B2 * 4/2005 Van Romer ..... 220/573
6,880,721 B1 * 4/2005 Barrett et al. ..... 220/573
6,921,201 B2 7/2005 Richardson et al.
7,036,676 B2 * 5/2006 Christensen ..... 220/565
7,086,781 B2 * 8/2006 Richardson et al. ..... 383/38
7,121,288 B2 10/2006 Jenkins
7,168,588 B2 * 1/2007 Van Romer ..... 220/571
7,188,747 B2 * 3/2007 Bennett et al. ..... 220/565
7,195,397 B2 * 3/2007 Williamson et al. ..... 383/33
7,374,062 B2 * 5/2008 Van Romer ..... 220/571
7,427,160 B2 * 9/2008 Richardson, Jr. et al. ..... 383/16
7,448,661 B2 * 11/2008 Daigle ..... 294/74
7,905,368 B1 * 3/2011 Christensen ..... 220/9.2
7,938,291 B2 * 5/2011 Christensen ..... 220/666
2001/0000464 A1 * 4/2001 Beale ..... 414/607
2003/0029873 A1 * 2/2003 Moffat et al. ..... 220/573
2004/0118844 A1 * 6/2004 Bennett et al. ..... 220/4.12
2004/0169041 A1 * 9/2004 Van Romer ..... 220/573
2005/0051547 A1 * 3/2005 Van Romer ..... 220/9.1
2005/0072779 A1 * 4/2005 Christensen ..... 220/9.1
2006/0219721 A1 * 10/2006 Van Romer ..... 220/571
2006/0222270 A1 10/2006 Modena
2007/0045483 A1 3/2007 Johnson et al.
2007/0127852 A1 6/2007 Town et al.
2008/0164263 A1 * 7/2008 Van Romer ..... 220/571
2008/0223863 A1 * 9/2008 Christensen ..... 220/666
2009/0045193 A1 2/2009 Jenkins
2010/0322538 A1 * 12/2010 Powell et al. ..... 383/16

* cited by examiner

CONCRETE WASHOUT BAG SYSTEM

CROSS REFERENCE TO RELATED APPLICATION

This application claims priority to provisional application Ser. No. 61/197,759 filed on Oct. 31, 2008. The above listed applications are incorporated herein by reference in its entirety.

FIELD OF THE INVENTION

The present invention relates to a washout system. Specifically, the present invention relates to an inexpensive concrete washout system that also provides for ease of transportation to construction sites, assembly, and removal.

BACKGROUND OF THE INVENTION

Concrete washout is a term used to describe the process of cleaning a concrete or ready-mix truck after it delivers its contents at a worksite. After pouring liquid cement, a truck operator must wash off the concrete delivery shoot and other equipment before the concrete hardens onto these surfaces. The water used to clean off the equipment mixes with and becomes contaminated with the product. This contaminated washout water must not be allowed to escape into the surrounding storm drains and ground water as it can contain an extremely high amount of dangerous contaminates which could get into nearby water sources.

Most states now impose strict, complex environmental regulations for operators at construction sites for the containment and removal of concrete, cement, mortar and/or paint washout runoffs. These regulations are cumbersome and complicated, including rules regarding container structure specifications, allowable placement of such containers on site, and even materials to be used for such containers. A violation of these local rules can result in the imposition of expensive fines and possible quasi-criminal penalties.

SUMMARY OF THE INVENTION

The present invention overcomes the disadvantages and shortcomings of the problems of the prior art by providing a washout system that is easy to transport and assemble at a desired construction site location. The invention also uses appropriate materials for containing washout water that comply with local regulations while still providing a simple, time-effective, and easily usable container system. The invention includes reinforcing structure that allows washout water to solidify within the container bag with the resulting heavy load able to be hoisted away for easy disposal.

In the exemplary embodiment of the invention, the washout system includes a frame and a foldable washout bag. The frame includes a plurality of connectors and tubes which when assembled provide a structure onto which the washout bag can be unfolded and placed for reception of washout oncrete runoff. Some of the tubes are joined by means of the connectors for placement on the ground. Others are placed into vertically aligned openings of the tubes which then connect to structures of the washout bag to hold it upright and in proper position.

The washout bag of the exemplary embodiment of the invention is manufactured from a thick water-proof material that provides for durability and superior strength. Exemplary materials include polypropylene and polyethylene. The washout bag is capable of being handling multiple washouts processes. The washout bag is also sufficiently reinforced to allow it to be hoisted for carrying away heavy loads without tearing.

The washout system is easily transportable to any desired location wherein the surface on which it is placed is essentially flat. The washout system can be placed on a grassy surface, concrete, or asphalt for example. It can be placed on a slightly sloping surface as well. The ultimate location of the washout system is one the complies with any state regulation yet is a convenient location in which an operator can perform a washout, for example at a location in which an operator has easy access to a water hose, and in which the location does not interfere with ongoing work or create a hazard. Because of its flexible transportability, the washout system of the invention is easy to place wherever desired.

Additional features and benefits of the concrete washout system will be apparent from the detailed description which follows, particularly when read in conjunction with the accompanying figures.

BRIEF DESCRIPTION OF THE DRAWINGS

For a more complete understanding of the present invention, reference is made to the following detailed description of the exemplary embodiment(s) considered in conjunction with the accompanying drawing in which.

DETAILED DESCRIPTION OF THE EXEMPLARY EMBODIMENTS

Figure 1:
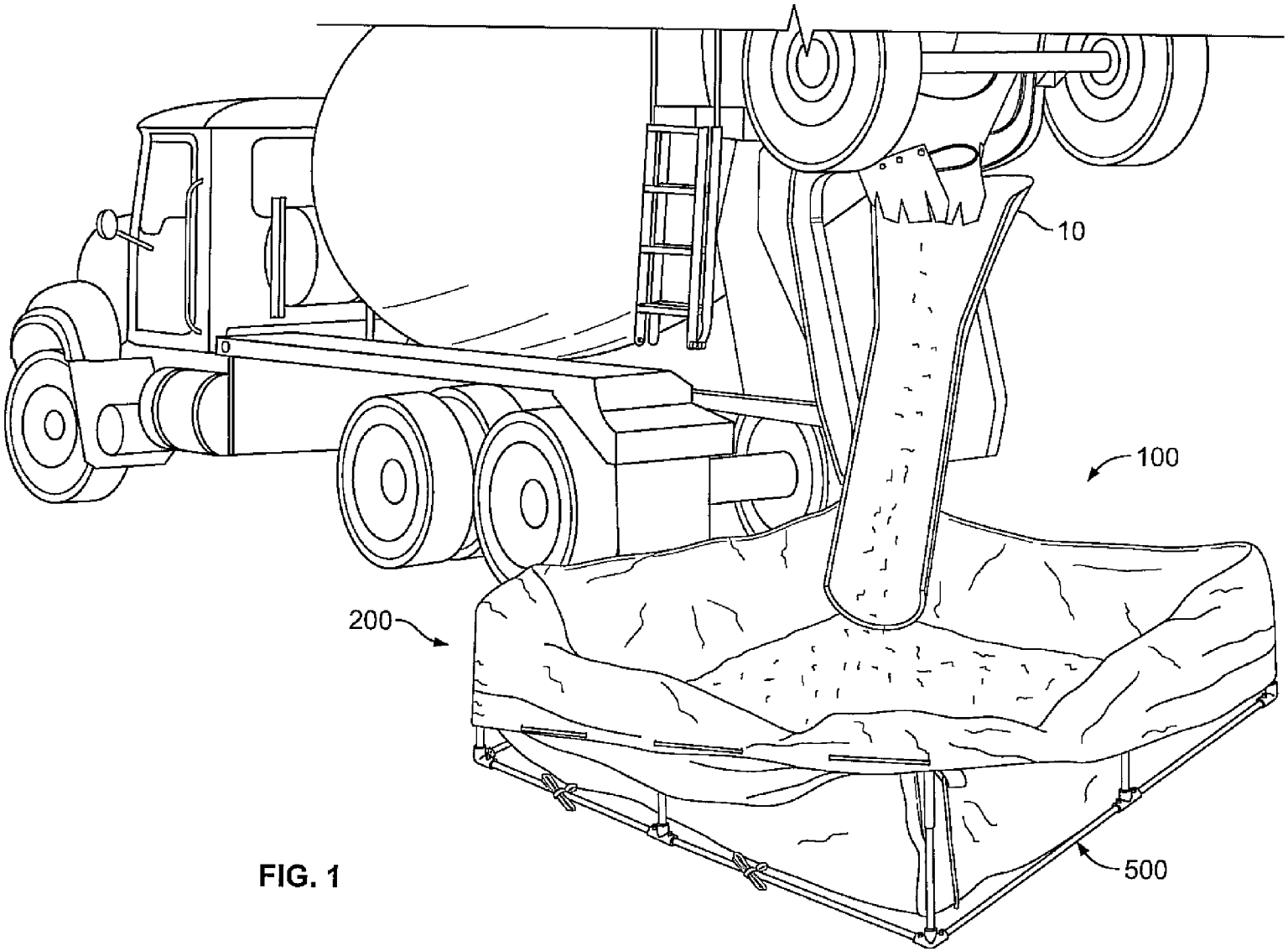
FIG. 1 is a perspective view of a concrete washout system constructed in accordance with an embodiment of the present invention showing the concrete washout system as it would be used and located in conjunction with a concrete mixer truck.

Referring to FIG. 1, a concrete washout system 100 constructed in accordance with the present invention is shown to include a frame 500 and a washout bag 200 to be used in conjunction with a cement mixer truck 10. As will be discussed below with further detail, the washout system 100 is configured for moveable placement on a level surface in a location that is convenient and accessible to a cement mixer truck 10.

Figure 2:
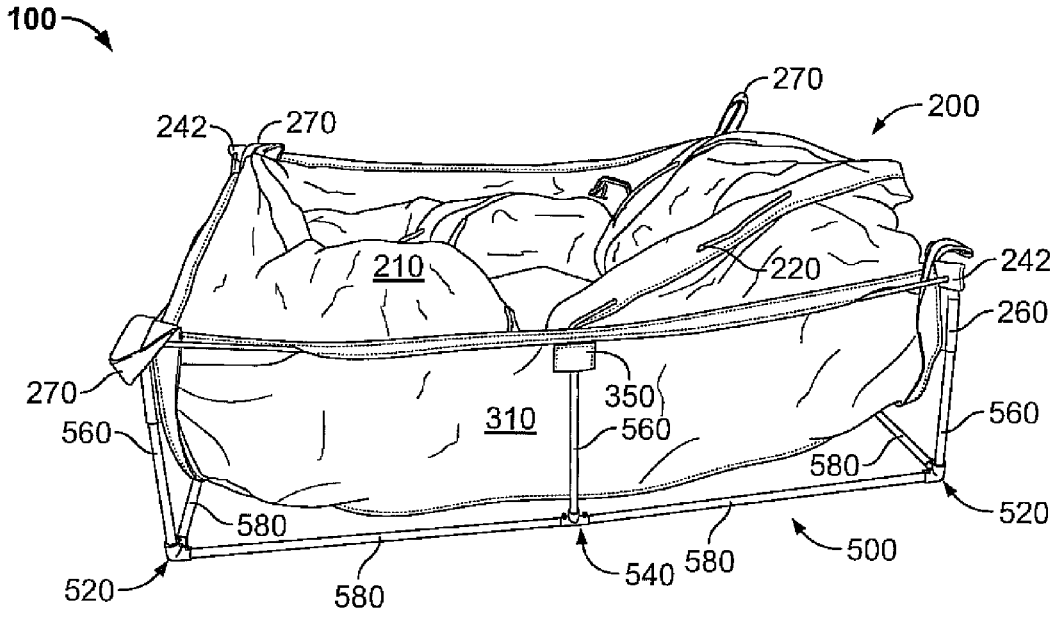
FIG. 2 is a front perspective view of the concrete washout system shown in FIG. 1.
Figure 3:
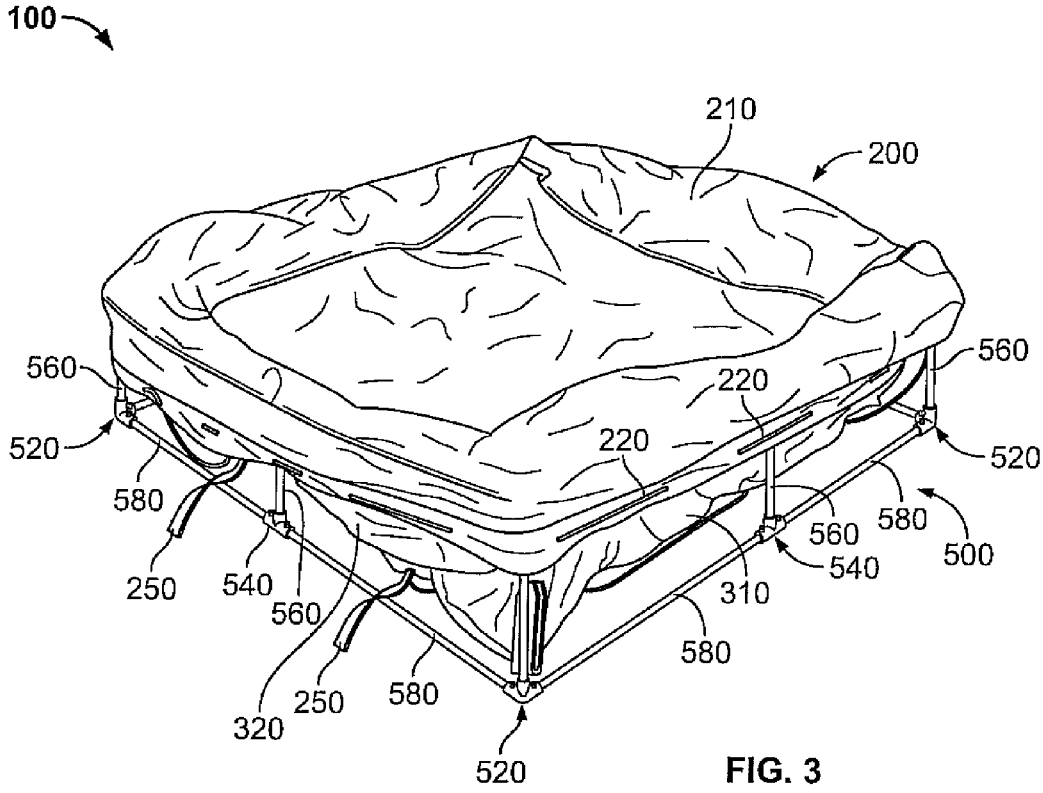
FIG. 3 is a side perspective view of the concrete washout system shown in FIG. 1.
Figure 4A:
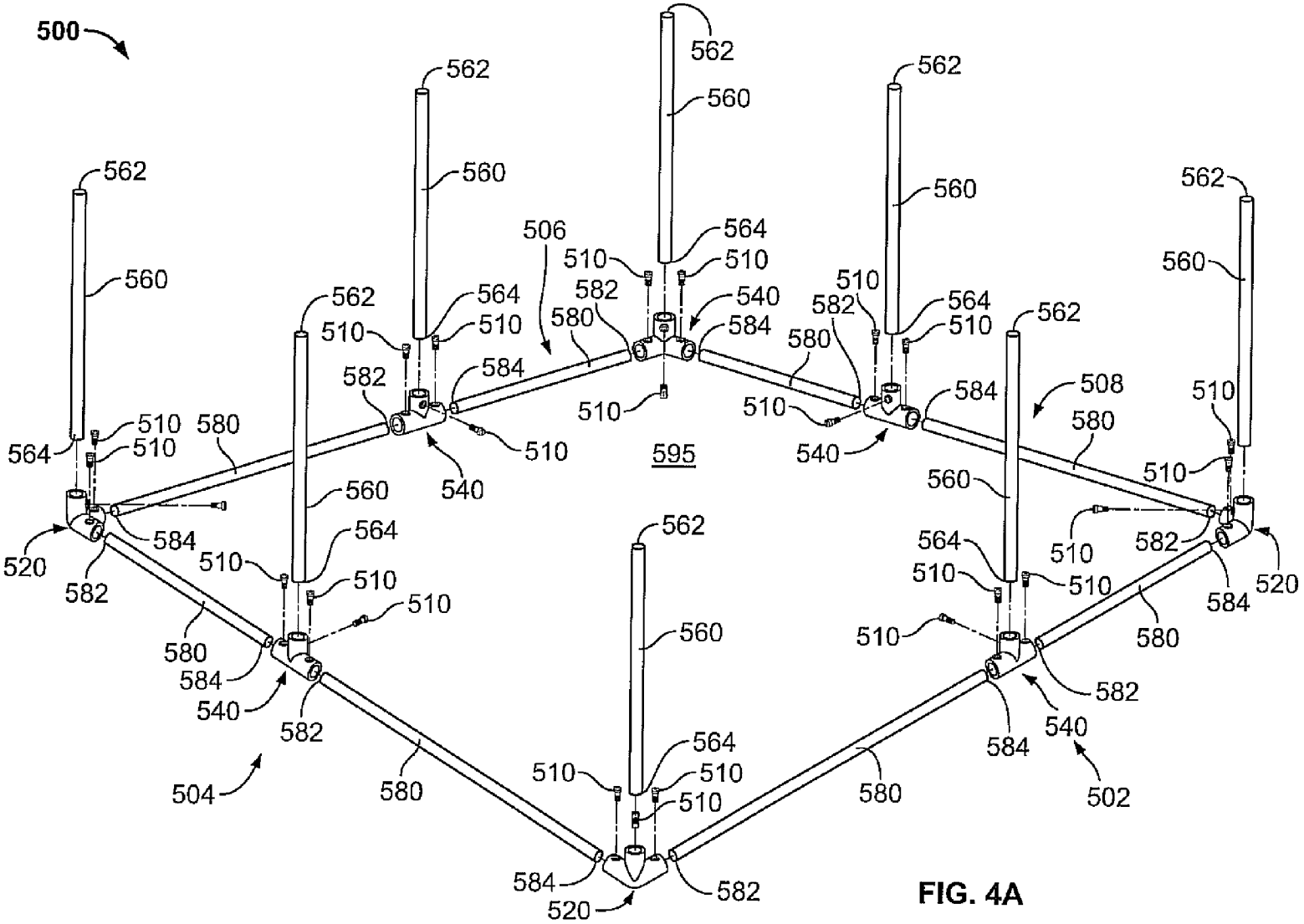
FIG. 4A is an exploded side perspective view showing the frame assembly without the washout bag shown in FIG. 1.
Figure 4B:
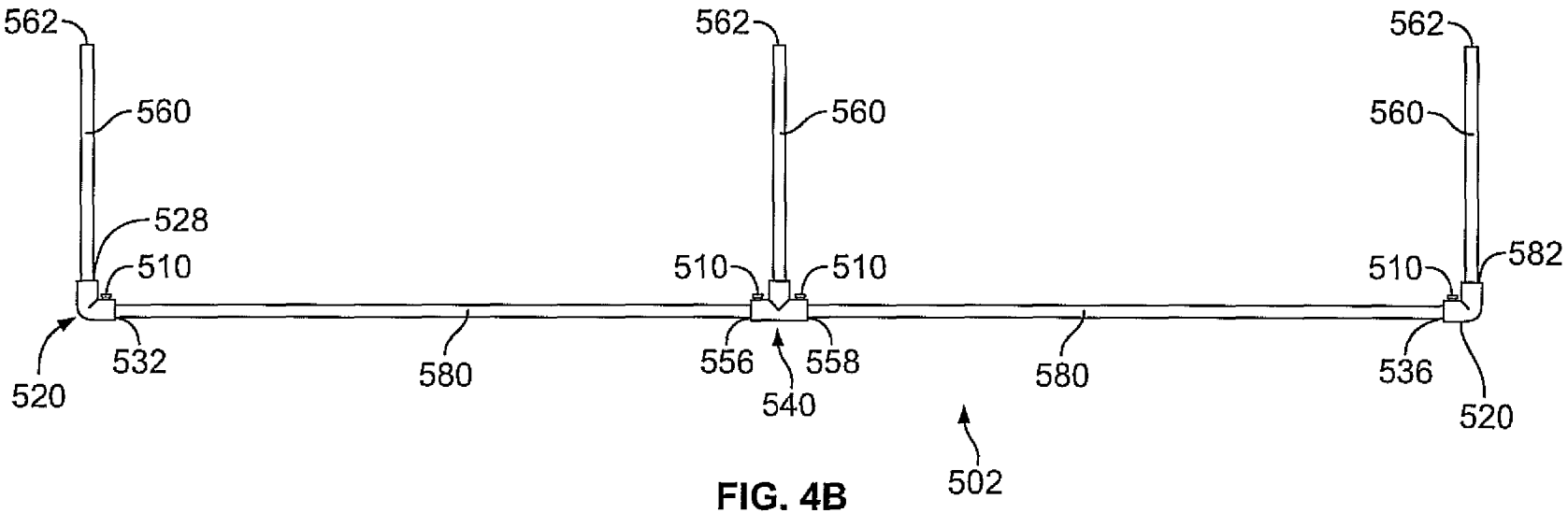
FIG. 4B is a side elevational view of the frame assembly without the washout bag shown in FIG. 1.
Figure 5:
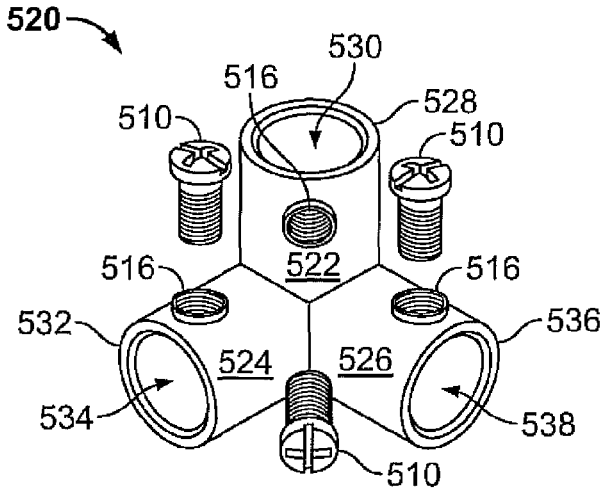
FIG. 5 is an exploded perspective view of a corner connector of the frame assembly shown in FIG. 1.
Figure 6:
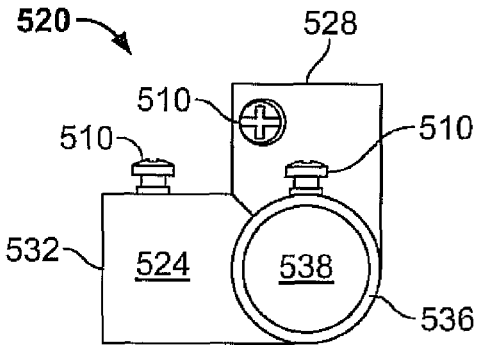
FIG. 6 is a right side elevational view of a corner connector of the frame assembly shown in FIG. 1.
Figure 7:
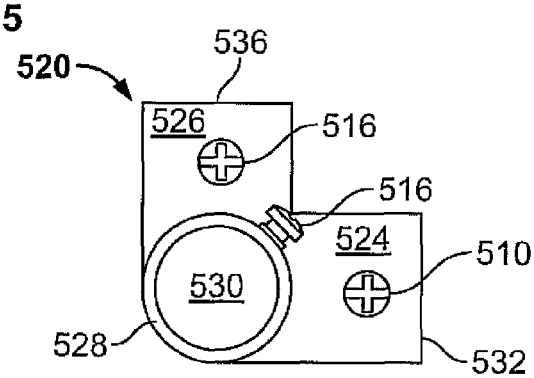
FIG. 7 is a top plan view of a corner connector of the frame assembly shown in FIG. 1.
Figure 8:
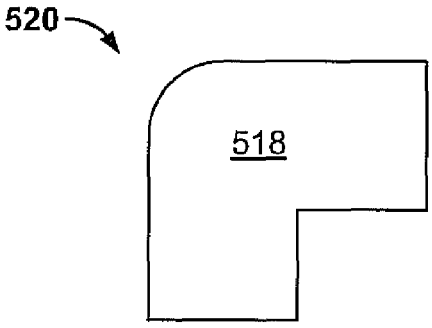
FIG. 8 is a bottom plan view of a corner connector of the frame assembly as shown in FIG. 1.
Figure 9:
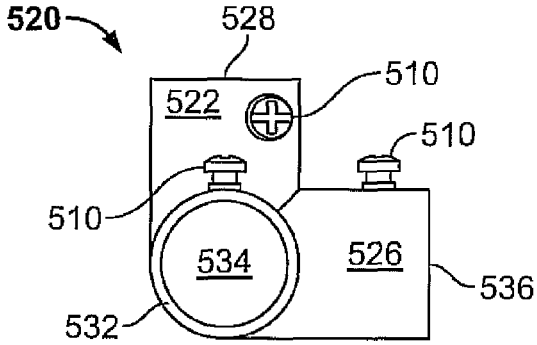
FIG. 9 is a left side elevational view of a corner connector of the frame assembly shown in FIG. 1.
Figure 10:
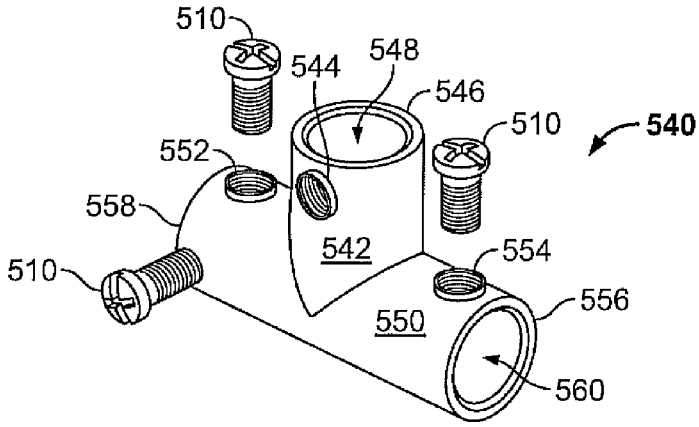
FIG. 10 is an exploded perspective view of a T-shaped connector of the frame assembly shown in FIG. 1.
Figure 11:
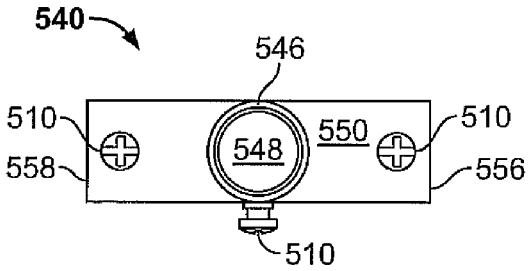
FIG. 11 is a top plan view of a T-shaped connector of the frame assembly shown in FIG. 1.
Figure 12:
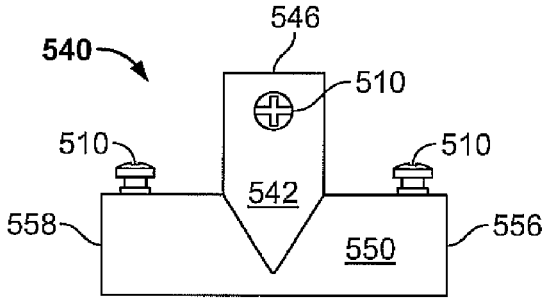
FIG. 12 is a front elevational view of a T-shaped connector of the frame assembly shown in FIG. 1.
Figure 13:
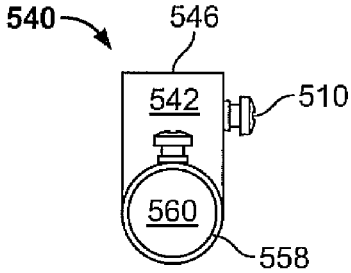
FIG. 13 is a right side elevational view of a T-shaped connector of the frame assembly shown in FIG. 1, a left side elevational view being a mirror image thereof.
Figure 14:
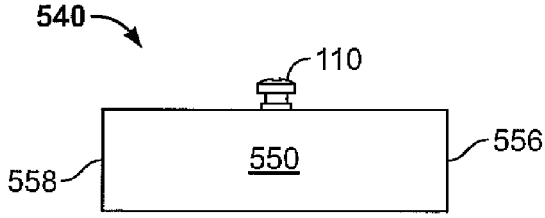
FIG. 14 is a bottom plan view of a T-shaped connector of the frame assembly shown in FIG. 1.
Figure 15:
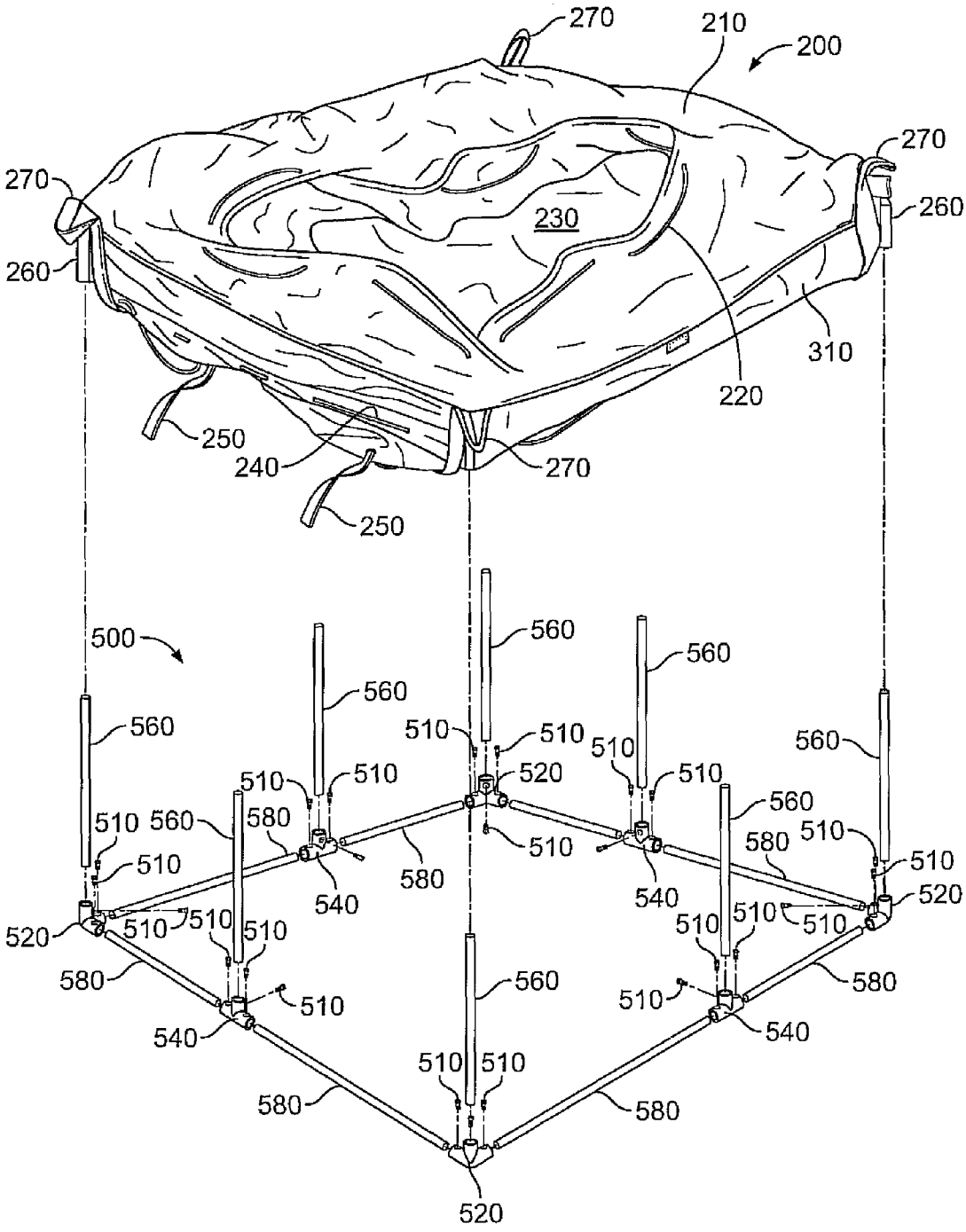
FIG. 15 is an exploded perspective view of the of the frame assembly and washout bag shown in FIG. 1.

Referring to FIGS. 1-3, the concrete washout system 100 includes a washout bag 200 that stands upright by releasable placement on a frame 500. The washout bag 200 is constructed of a industrial strength reinforced plastic material capable of securely containing heavy loads. At the job site, the frame 500 is first releasably assembled at a desired location. Then the washout bag 200 is secured to the frame 500 by slidingly engaging the corner sleeves 260 over the vertical frame tubes 560 of the corners of the frame 500, and positioning the vertical frame tubes 560 that are positioned at midpoints of each side of the frame 500 into center pockets 350 on each side. Once placed on the frame 500, the top 210 of the washout bag 200 can be pulled over the vertical frame tubes 560 of the assembled frame 500 to open up the washout bag 200 for filling. The washout bag assembly 100 is completed by pulling the washout bag 200 into the open area 595 created by the frame 500 and securing the washout bag 200 at its bottom 300 by releasably fastening bag ties 250 to the horizontal frame tubes 580.

Referring to FIGS. 4-14, the frame 500 includes a plurality of frame tubes 560, 580 and connectors 520, 540, which, upon assembly creates a frame first side 502, frame second side 504, which is substantially perpendicular thereto, a frame third side, 506, opposite to the frame first side 502, and a frame fourth side 508, opposite of the frame third side 504. The frame sides, 502, 504, 506, 508 are configured to form a substantially square open center area 595 into which the washout bag 200 is pulled into place. Each vertical frame tube 560 is essentially a hollow, elongated cylinder that is annular in cross section and includes a first end 562 and a second end 564. Each horizontal frame tibe 580 is also essentially a hollow, elongated cylinder that is annular in cross section and includes a first end 582 and a second end 584.

Referring to FIGS. 4-14, the horizontal frame tubes 580 of the frame 500 form the frame sides 502, 504, 506, 508 upon joining at the connectors 520, 540. Each horizontal frame tube 580 slidingly and releasably engages with a corner connector 520 at one end and a straight connector 540 at the opposite end. Either end 582, 584 can fit into either connector 520, 540.

As shown in FIGS. 4-9, each corner frame connector 520 includes a first horizontal segment 524, a second horizontal segment 526, substantially perpendicular to said first horizontal segment 524, a vertical segment 522 substantially perpendicular to each of the horizontal segments 524, 526, and a bottom surface 518. First horizontal segment 524 includes an end surface 532, a cavity 534 for receiving a horizontal frame tube 580, and a screw hole 516. Second horizontal segment 526 includes an end surface 536, a cavity 538 for receiving a horizontal frame tube 580, and a screw hole 516. The vertical segment 522 includes an top surface 528 and a vertical cavity 530 for receiving the first end 562 of a vertical frame tube 560.

As shown in FIGS. 10-14, each straight frame connector 540 is substantially T-shaped, and includes a horizontal leg 550 with a first end 558 and a second end 556 and a vertical leg 542. The horizontal leg 550 is annular in cross section and includes a cavity 560 for releasably receiving either end of a horizontal frame tube 580. The horizontal leg 550 includes a first screw hole 552 and a second screw hole 554. The vertical leg 542 is annular in cross section and includes a cavity 548 for releasably receiving one end of the vertical frame tube 560 and a vertical screw hole 544.

Each of the horizontal frame tubes 580 and vertical frame tubes 560 is releasably secured into the appropriate connector 520, 540 by means of frame screws 510. Frame screws threadingly engage with the connector holes 516, 552, 554.

Referring to FIGS. 15-21, the washout bag 200 is configured for foldable transportation and placement on the frame 500 at a construction site. The washout bag 200 includes a front side 310, back side 340, right side 320, a left side 330, a top side 210 and a bottom side 300. Once the frame 500 is assembled at a desired location, the washout bag 200 is lowered on top of the frame 500, and attached to the frame 500. The bag corner sleeves 260 slidingly and releasably engage over the second end 564 of each vertical frame tubes 560 placed at each corner of the frame 500. The bag central sleeve 350 likewise slidingly engages over second end 564 of the vertical frame tube 560 that is placed in the vertical leg cavity 548 of the T-shaped straight connector 540 at substantially the midpoint of each side of the frame 500. Upon being secured onto the frame, the sides 310, 320, 330, 340 of the washout bag 200 are pulled down into the open area 595 created by the frame 500 and rest at a substantially perpendicular position with respect to the ground with the bag bottom 300 resting on the ground.

The washout bag 200 is further releasably secured onto the frame by means of tie downs 250. Two tie downs 250 are included on the bag left side 330, and two are included on the bag right side 320. The tie downs 250 are fastened to horizontal frame tubes 580. The washout bag 200 is further releasably fastened onto the frame 500 by means of pulling taut and attaching the side drawstrings 240 into drawstring clamps 590. These side drawstrings 240 pass through the hole of the drawstring tab 242 and are placed into drawstring clamps 590. The drawstring clamps 590 attach to the frame vertical poles 560 positioned at the frame corners by means of rivets or bolts.

Figure 16:
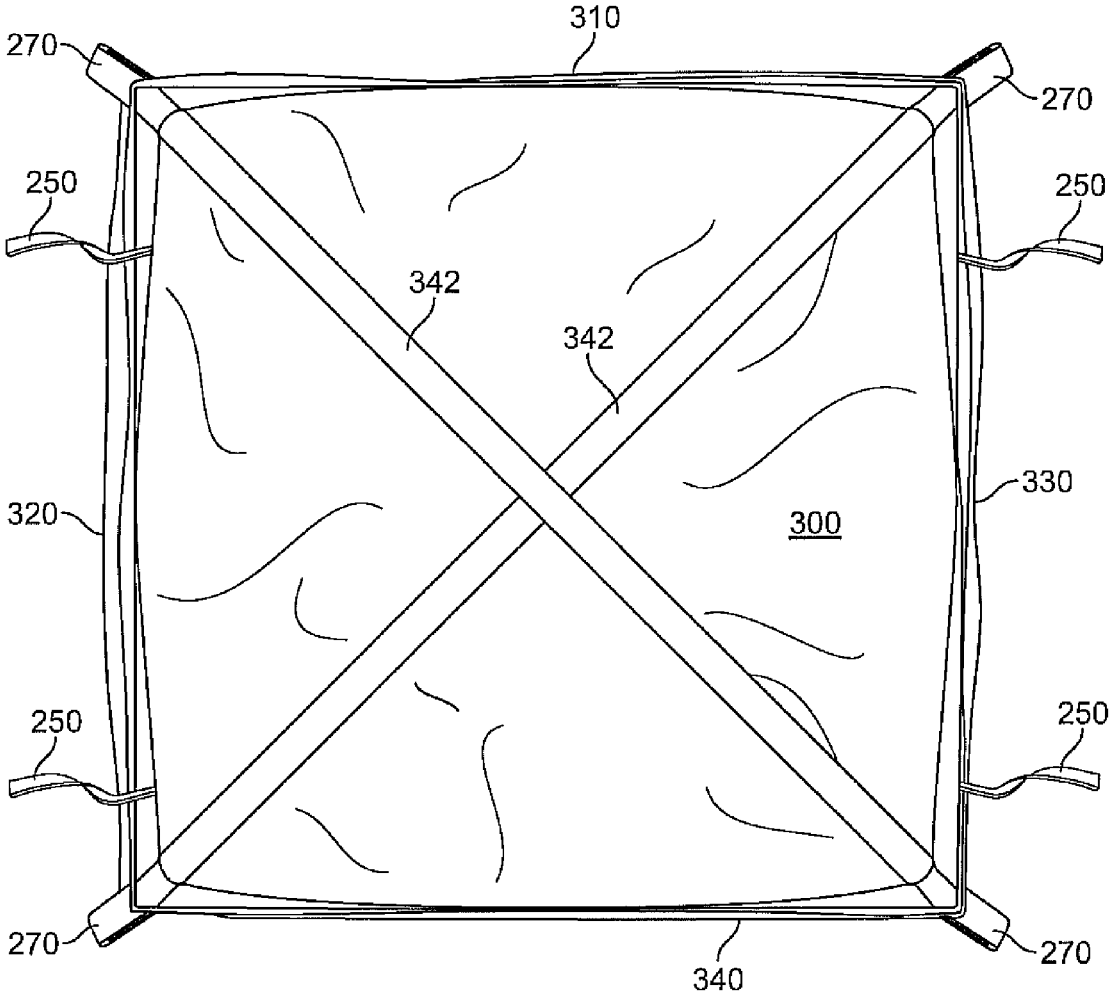
FIG. 16 is a bottom plan view of the washout bag shown in FIG. 1.
Figure 17:
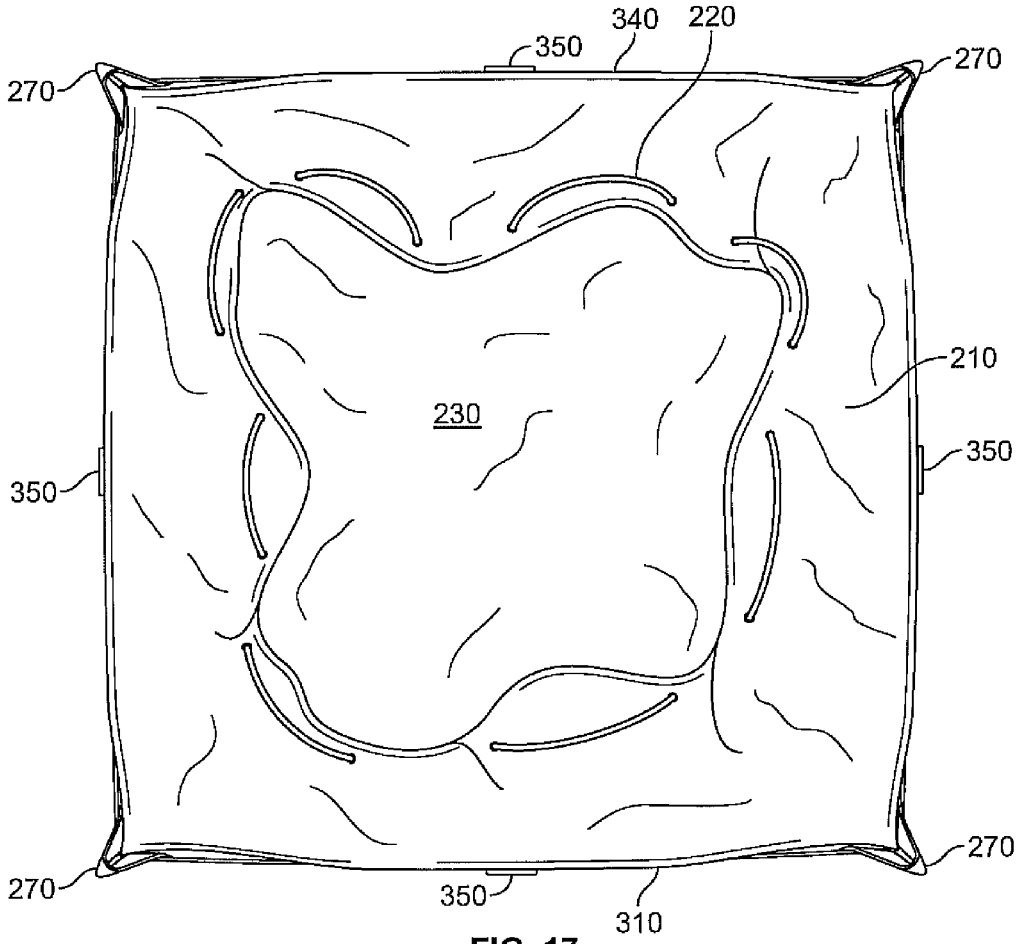
FIG. 17 is a top plan view of the washout bag shown in FIG. 1.
Figure 18:
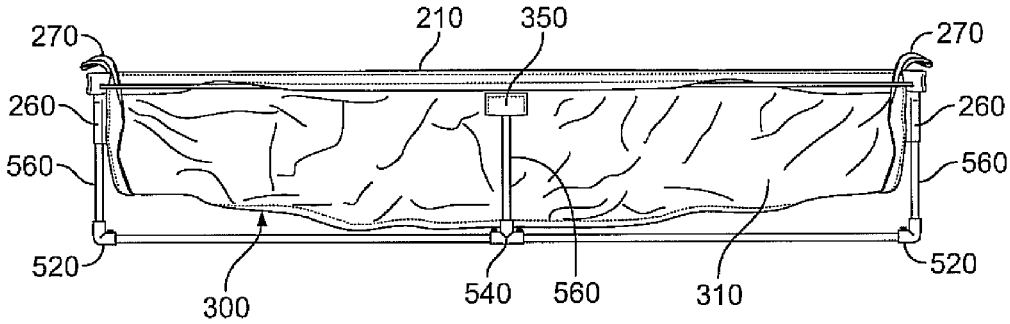
FIG. 18 is a right side elevational view of the washout system shown in FIG. 1, a left side, right side and rear view being mirror images thereof.
Figure 19:
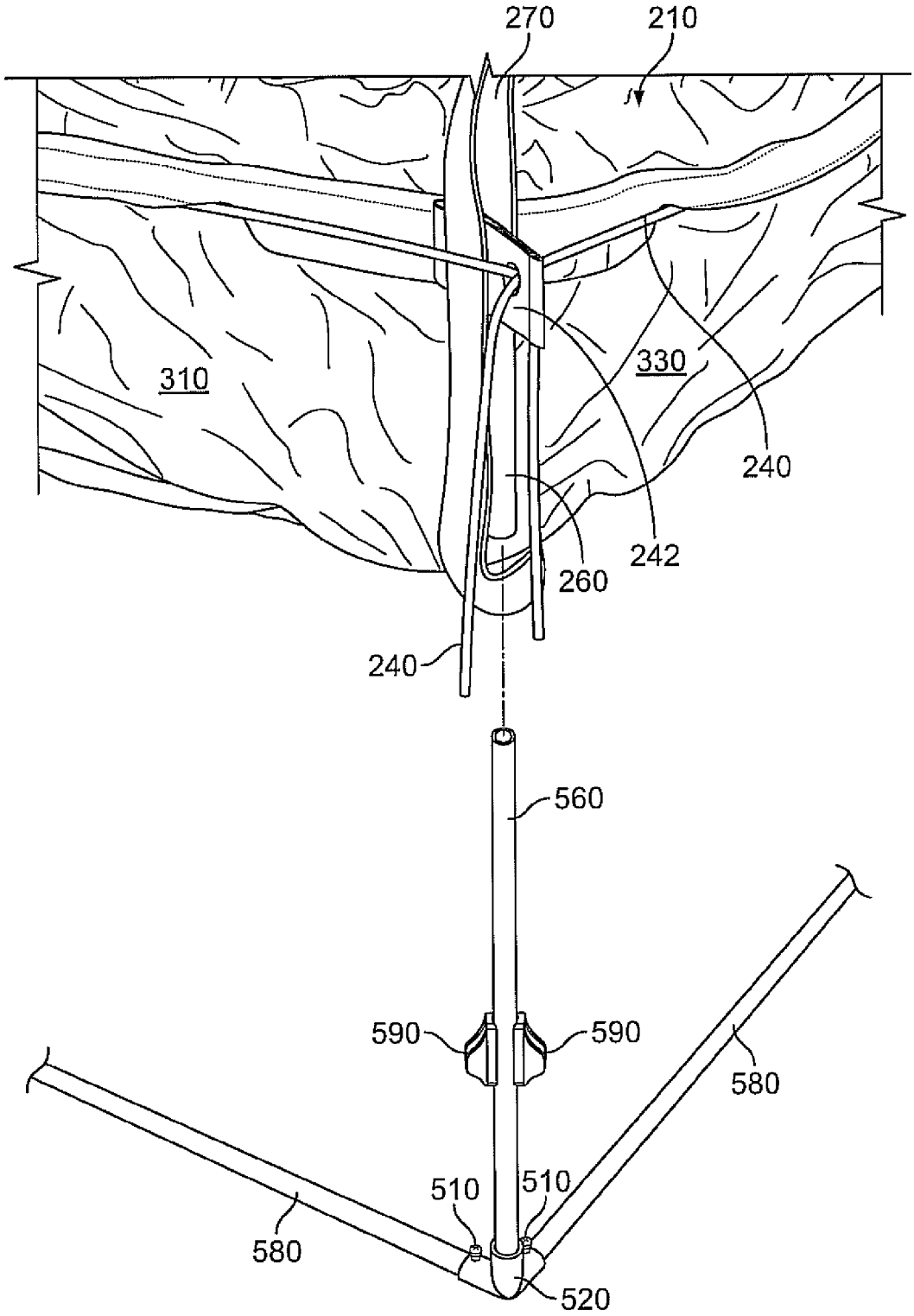
FIG. 19 is a cut away perspective view of the corner of the washout bag system showing how the bag fits onto the frame as shown in FIG. 1.
Figure 20:
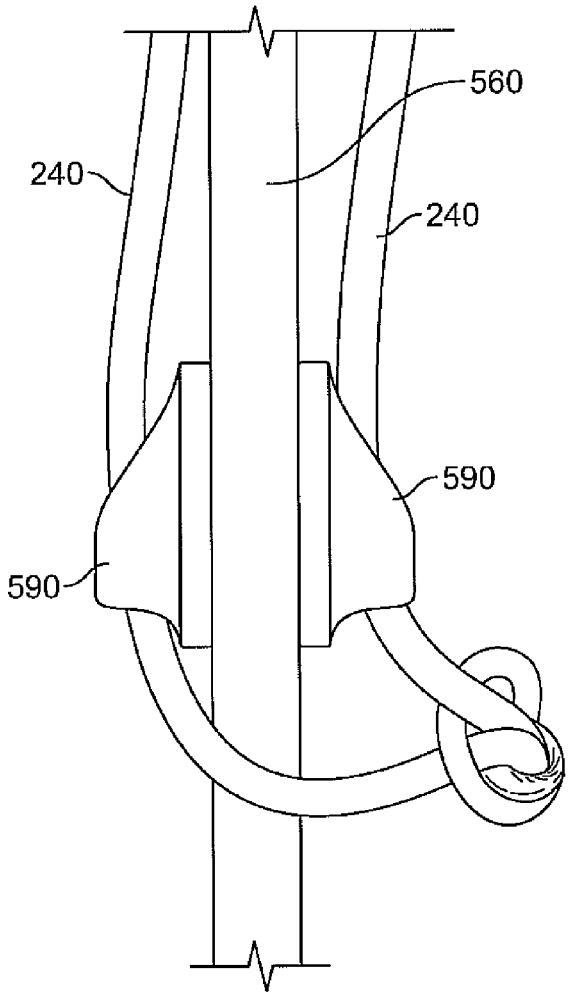
FIG. 20 is a cut away side elevational view of the frame assembly showing the drawstring clamp attached to the vertical pole of the frame assembly shown in FIG. 1.
Figure 21:
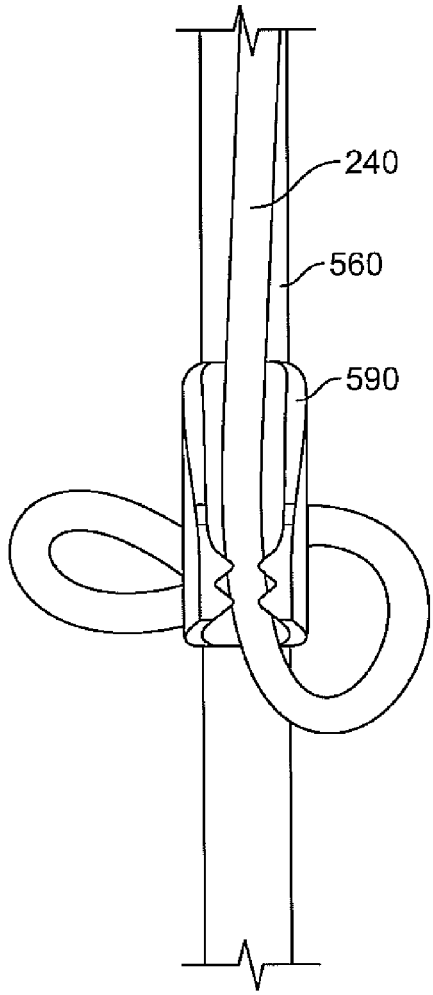
FIG. 21 is a cut away front elevational view of the frame assembly showing the drawstring clamp attached to the vertical pole of the frame assembly shown in FIG. 1.

Referring to FIGS. 16-18, the bottom 300 of the washout bag 200 is formed from a unitary continuous piece of material. The bottom 300 includes two criss-crossing support straps 342 which help resist tearing of the bag 200 with heavy loads. The tie downs 250 are sewn to the edges of the bottom 300 on opposite sides. The top 210 of washout bag 200 has an opening around which a top drawstring 220 is included. The top drawstring 220 is loosely strung through holes in the top that allows the top to be stretched over the sides 310, 320, 330, 340 of the bag 200. When folded over the sides 310, 320, 330, 340, the opening of the top 210 allows access into the bag interior 230 and into which concrete washout is poured. The top 210 is also configured to include hoisting loops 270 at each corner.

Figure 22:
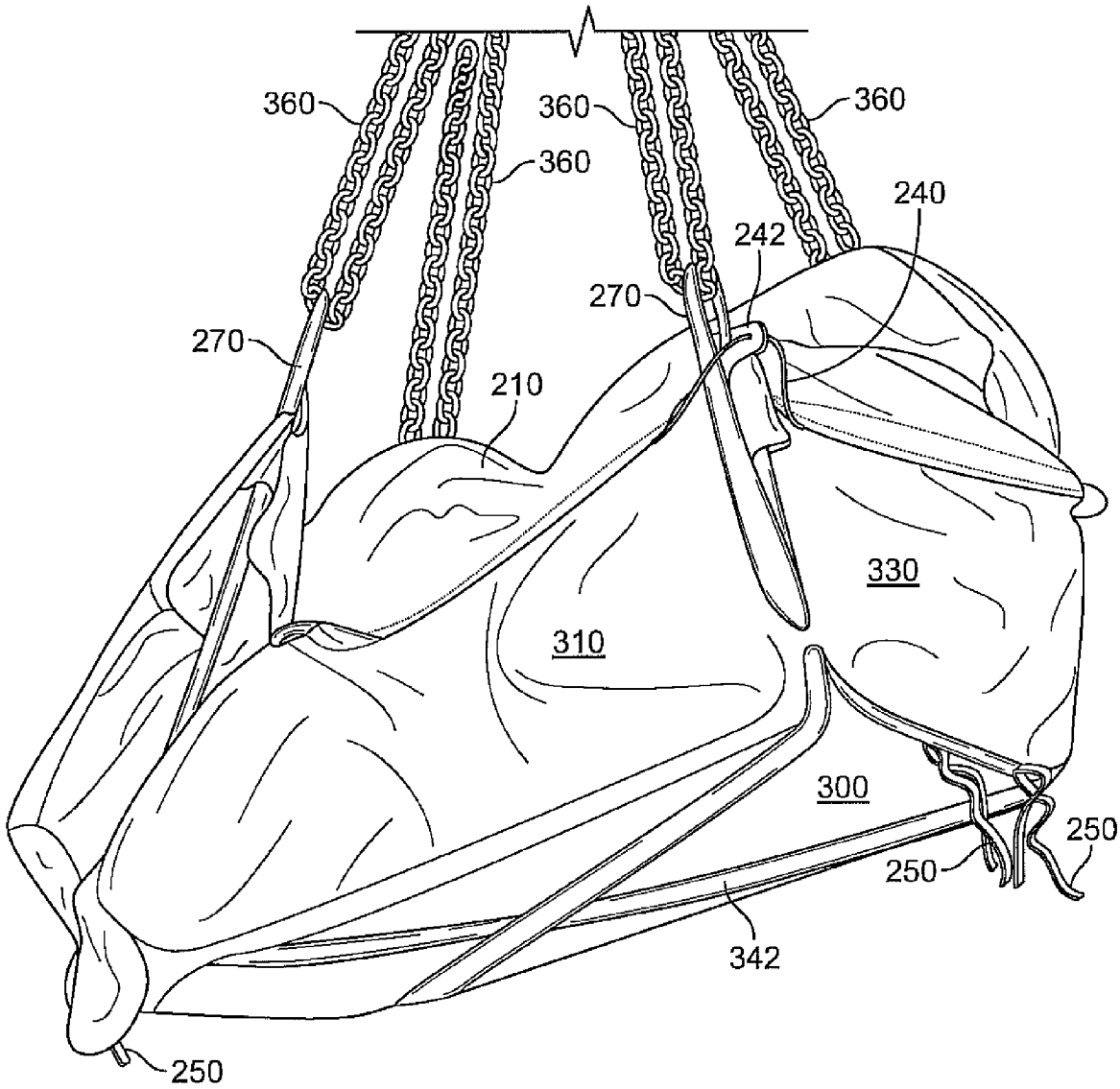
FIG. 22 is a perspective view of the washout bag being hoisted away for removal.

Referring to FIG. 22, the washout bag 200 allows for lifting off the frame 500 and removal from the site by means of the hoisting loops 270. Typically, the concrete mixer truck operator washes remaining concrete from the interior of his vehicle and the delivery shoot by means of a water hose. The runoff enters the interior 230 of the washout bag 200 and is allowed to stand until the mixture solidifies. The top drawstring 220 is pulled tight to close the bag. Then a hoisting crane is used to lift the bag 200 off of the frame 500 by attaching chains 360 to the hoisting loops 270 at the top of the bag 210.

It will be understood that a person skilled in the art may make many variations and modifications without departing from the spirit and the scope of the present invention. For example, the washout system 100 could be used for other kinds of runoff other than concrete. The washout system 100 could be used to collect solid waste materials as well. The side drawstrings could attach to the vertical frame legs by means other than the drawstring clamps. Further stabilizing structure could be added include more tie downs. All such variations and modifications, including those discussed above, are intended to be included within the scope of the present invention as defined in the appended claims.

What is claimed is:

1. A concrete washout system comprising:

a frame wherein said frame includes horizontal frame tubes, vertical frame tubes, frame connectors and drawstring clamps wherein said drawstring clamps are affixed to said vertical frame tubes; and a foldable bag having a first wall, a second wall opposite said first wall, a third wall substantially perpendicular to said first wall and said second wall, and a fourth wall opposite said third wall, bottom surface, a top surface opposite said bottom surface, a cavity, a plurality of hoisting loops, a top drawstring, a side drawstring, and a plurality of sleeves, wherein said top drawstring is disposed around an opening in said top surface, said bottom surface of said foldable bag includes a plurality of straps, and wherein said plurality of sleeves slidingly and releasably engage with said vertical frame tubes of said frame at the corners of said foldable bag and said side drawstring is affixed to said drawstring clamps of said frame.

2. The concrete washout system of claim 1 wherein said horizontal frame tubes and said vertical frame tubes are annular in cross section.

3. The concrete washout system of claim 1 wherein said frame connectors include a plurality of openings for releasably receiving said horizontal frame tubes and said vertical frame tubes.

4. The concrete washout system of claim 1 wherein said foldable bag is constructed of polypropylene.

5. The concrete washout system of claim 1 wherein said foldable bag is constructed of polyethylene.

6. The concrete washout system of claim 1 wherein said plurality of said straps on said bottom surface of said foldable bag are configured to criss-cross.

7. The concrete washout system of claim 1 wherein said frame connectors include a plurality of screw holes, wherein said screw holes are threaded.

8. The concrete washout system of claim 7 wherein said frame connectors include a plurality of screws wherein said screws threadingly engage with said screw holes of said frame connectors.

* * * * *